US007373095B2

(12) United States Patent
Arai

(10) Patent No.: US 7,373,095 B2
(45) Date of Patent: May 13, 2008

(54) IMAGE FORMING SYSTEM INCLUDING A FINISHING PROCESS FUNCTION RESETTING SECTION

(75) Inventor: Hiroyuki Arai, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 209 days.

(21) Appl. No.: 11/296,970

(22) Filed: Dec. 8, 2005

(65) Prior Publication Data

US 2006/0127122 A1 Jun. 15, 2006

(30) Foreign Application Priority Data

Dec. 15, 2004 (JP) ..... 2004-362949
Aug. 10, 2005 (JP) ..... 2005-231988

(51) Int. Cl.
*G03G 15/00* (2006.01)

(52) U.S. Cl. ..... 399/82; 399/8; 399/45; 399/81; 399/407

(58) Field of Classification Search ..... 399/16, 399/45, 82, 81, 8, 9, 407
See application file for complete search history.

(56) References Cited

U.S. PATENT DOCUMENTS

| | | | | |
|---|---|---|---|---|
| 5,241,355 | A * | 8/1993 | Yamashita et al. | 399/407 |
| 6,606,466 | B2 * | 8/2003 | Sato | 399/82 |
| 6,671,472 | B2 * | 12/2003 | Shimizu et al. | 399/82 |
| 7,072,799 | B2 * | 7/2006 | Kojima | 399/8 X |
| 2006/0018696 | A1 * | 1/2006 | Mori et al. | 399/407 |
| 2006/0216054 | A1 * | 9/2006 | Willis | 399/81 |

FOREIGN PATENT DOCUMENTS

JP 05-107847 A * 4/1993

* cited by examiner

*Primary Examiner*—Sophia S. Chen
(74) *Attorney, Agent, or Firm*—Cantor Colburn LLP

(57) ABSTRACT

There is described an image forming system including an image forming section, a finishing process section, wherein restriction contents of finishing process function are set in the image forming system, and a finishing process function resetting section that resets the restriction contents of the finishing process function in accordance with a recording medium.

13 Claims, 11 Drawing Sheets

FIG. 5

| SHEET TYPE | BASIC WEIGHT ($g/m^2$) | FINISHING PROCESS RESTRICTION INFORMATION (SHEETS) | | | | |
|---|---|---|---|---|---|---|
| | | STAPLE | BINDING IN THE MIDDLE | FOLDING IN THE MIDDLE | THREE - FOLDING | PUNCH |
| PLAIN PAPER | 64 - 74 | 50 | 20 | 3 | 3 | YES |
| | 75 - 80 | 50 | 20 | 3 | 3 | YES |
| | 81 - 105 | 50 | 16 | 1 | 1 | YES |
| | 106 - 162 | 20 | NO | NO | NO | YES |
| | 163 - 209 | 20 | NO | NO | NO | NO |
| | 210 - 256 | NO | NO | NO | NO | NO |
| FINE - QUALITY PAPER | 64 - 74 | 50 | 20 | 3 | 3 | YES |
| | 75 - 80 | 50 | 20 | 3 | 3 | YES |
| | 81 - 105 | 50 | 16 | 1 | 1 | YES |
| | 106 - 162 | 20 | NO | NO | NO | YES |
| | 163 - 209 | 20 | NO | NO | NO | NO |
| | 210 - 256 | NO | NO | NO | NO | NO |
| COATED PAPER | 64 - 74 | 20 | 3 | NO | NO | YES |
| | 75 - 80 | 20 | 3 | NO | NO | YES |
| | 81 - 105 | 20 | 1 | NO | NO | YES |
| | 106 - 162 | 3 | NO | NO | NO | NO |
| | 163 - 209 | 3 | NO | NO | NO | NO |
| | 210 - 256 | NO | NO | NO | NO | NO |
| LABEL PAPER | 64 - 74 | 20 | NO | NO | NO | NO |
| | 75 - 80 | 20 | NO | NO | NO | NO |
| | 81 - 105 | 20 | NO | NO | NO | NO |
| | 106 - 162 | 3 | NO | NO | NO | NO |
| | 163 - 209 | 3 | NO | NO | NO | NO |
| | 210 - 256 | NO | NO | NO | NO | NO |

FIG. 11

| SHEET TYPE | BASIC WEIGHT ($g/m^2$) | SHEET SIZE, LENGTH IN FEEDING DIRECTION (mm) | FINISHING PROCESS RESTRICTION INFORMATION (SHEETS) | | | | | | |
|---|---|---|---|---|---|---|---|---|---|
| | | | STAPLE | BINDING IN THE MIDDLE | FOLDING IN THE MIDDLE | THREE - FOLDING | Z - FOLDING | PUNCH | STAPLE + Z - FOLDING |
| PLAIN PAPER | 64 - 74 | - 399 | 50 | 20 | 3 | 3 | YES | YES | 40 |
| | | 400 - | 25 | | | | | | 20 |
| | 75 - 80 | - 399 | 50 | 20 | 3 | 3 | YES | YES | 40 |
| | | 400 - | 25 | | | | | | 20 |
| | 81 - 105 | - 399 | 50 | 16 | 1 | 1 | YES | YES | 40 |
| | | 400 - | 25 | | | | | | 20 |
| | 106 - 162 | - 399 | 20 | NO | NO | NO | YES | YES | 16 |
| | | 400 - | 10 | | | | | | 8 |
| | 163 - 209 | - 399 | 20 | NO | NO | NO | NO | NO | NO |
| | | 400 - | 10 | | | | | | NO |
| | 210 - 256 | - 399 | NO | NO | NO | NO | NO | NO | NO |
| | | 400 - | NO | | | | | | NO |
| FINE-QUALITY PAPER | 64 - 74 | - 399 | 50 | 20 | 3 | 3 | YES | YES | 40 |
| | | 400 - | 25 | | | | | | 20 |
| | 75 - 80 | - 399 | 50 | 20 | 3 | 3 | YES | YES | 40 |
| | | 400 - | 25 | | | | | | 20 |
| | 81 - 105 | - 399 | 50 | 16 | 1 | 1 | YES | YES | 40 |
| | | 400 - | 25 | | | | | | 20 |
| | 106 - 162 | - 399 | 20 | NO | NO | NO | YES | YES | 16 |
| | | 400 - | 10 | | | | | | 8 |
| | 163 - 209 | - 399 | 20 | NO | NO | NO | NO | NO | NO |
| | | 400 - | 10 | | | | | | NO |
| | 210 - 256 | - 399 | NO | NO | NO | NO | NO | NO | NO |
| | | 400 - | NO | | | | | | NO |
| COATED PAPER | 64 - 74 | - 399 | 20 | 3 | NO | NO | YES | YES | 16 |
| | | 400 - | 10 | | | | | | 8 |
| | 75 - 80 | - 399 | 20 | 3 | NO | NO | YES | YES | 16 |
| | | 400 - | 10 | | | | | | 8 |
| | 81 - 105 | - 399 | 20 | 1 | NO | NO | YES | YES | 16 |
| | | 400 - | 10 | | | | | | 8 |
| | 106 - 162 | - 399 | 3 | NO | NO | NO | NO | NO | NO |
| | | 400 - | 1 | | | | | | NO |
| | 163 - 209 | - 399 | 3 | NO | NO | NO | NO | NO | NO |
| | | 400 - | 1 | | | | | | NO |
| | 210 - 256 | - 399 | NO | NO | NO | NO | NO | NO | NO |
| | | 400 - | NO | | | | | | NO |
| LABEL PAPER | 64 - 74 | - 399 | 20 | NO | NO | NO | NO | NO | NO |
| | | 400 - | 10 | | | | | | NO |
| | 75 - 80 | - 399 | 20 | NO | NO | NO | NO | NO | NO |
| | | 400 - | 10 | | | | | | NO |
| | 81 - 105 | - 399 | 20 | NO | NO | NO | NO | NO | NO |
| | | 400 - | 10 | | | | | | NO |
| | 106 - 162 | - 399 | 3 | NO | NO | NO | NO | NO | NO |
| | | 400 - | 1 | | | | | | NO |
| | 163 - 209 | - 399 | 3 | NO | NO | NO | NO | NO | NO |
| | | 400 - | 1 | | | | | | NO |
| | 210 - 256 | - 399 | NO | NO | NO | NO | NO | NO | NO |
| | | 400 - | NO | | | | | | NO |

IMAGE FORMING SYSTEM INCLUDING A FINISHING PROCESS FUNCTION RESETTING SECTION

CROSS REFERENCE TO RELATED APPLICATION

This application is based on Japanese Patent Application No. 2004-362949 filed on Dec. 15, 2004 and Japanese Patent Application No. 2005-231988 filed on Aug. 10, 2005, in Japanese Patent Office, the entire content of which is hereby incorporated by reference.

BACKGROUND OF THE INVENTION

1. Field of the Invention

The present invention relates to an image forming system provided with a finishing process device.

2. Description of the Related Art

There have been used commonly finishing work apparatuses each conducting finishing process such as stapling processing and folding processing for the sheet on which images are formed by an image forming apparatus such as a copying machine and a printer. The number of sheets to be processed in terms of finishing process is sometimes restricted, depending on finishing process functions.

For example, in TOKKAIHEI No. 11-2999), there is proposed an image forming apparatus capable of establishing the number of sheets to be stapled suitable for each finishing work apparatus, in accordance with a finishing work apparatus connected with the image forming apparatus.

Further, in TOKKAI No. 2004-123306), there is proposed an image forming apparatus capable of establishing a limited value of the number of sheets to be processed, depending on a sheet size, a sheet thickness and a type of a finishing process function, because the number of sheets capable of being subjected to finishing process varies for each sheet.

However, in the market of color machines such as POD (Print On Demand), there are used recording sheets in a wide variety. Since it is difficult to guarantee operations of an image forming apparatus for all kinds of recording sheets, specifications of the apparatus have been determined under the condition of a typical recording sheet serving as a designated sheet, and the restricted number of sheets has been determined under the designated sheet that serves as a criteria even for each finishing process function. Therefore, there is caused a problem that the finishing process function cannot be conducted even for the recording sheet that can be processed in terms of finishing process without any problem.

SUMMARY OF THE INVENTION

An image forming system comprising: an image forming section; a finishing process section in which finishing process conducts for a recording medium ejected from the image forming section, wherein restriction contents of finishing process function by the finishing process section are set in the image forming system; and a finishing process function resetting section that resets the restriction contents of the finishing process function in accordance with a recording medium.

An image forming system comprising: a plurality of image forming apparatuses each having the following structure, an image forming section, and a finishing process section in which finishing process conducts for a recording medium ejected from the image forming section, in which wherein restriction contents of finishing process function by the finishing process section are set in each image forming apparatus, and plural image forming apparatuses are connected each other through a network, wherein at least one of the plural image forming apparatuses is provided with a finishing process function resetting section that resets the restriction contents of the finishing process function in accordance, with a recording medium, and finishing process restriction information showing the restriction contents of finishing process function reset in one of the plural image forming apparatuses are shared by other image forming apparatus.

An image forming system comprising: an image forming apparatuses having the following structure; an image forming section, and a finishing process section in which finishing process conducts for a recording medium ejected from the image forming section, wherein restriction contents of finishing process function by the finishing process section are set for each recording medium in the image forming apparatus; and an instructing device which instructs image forming and finishing process to the image forming apparatus, wherein the image forming apparatus and the instructing device are connected through a network, the image forming apparatus is provided with a finishing process function resetting section which resets the restriction contents of the finishing process function in accordance with a recording medium and a transmission section Which transmits finishing process restriction information showing the restriction contents of the finishing process function to the instructing device, and the image forming system controls whether to make the finishing process function to be selectable or not based on the finishing process restriction information if a recording medium whose restriction contents of the finishing process function are set is selected in the in the instructing device.

An image forming system comprising: an image forming section; a finishing process section in which finishing process conducts for a recording medium ejected from the image forming section; and a restricted number of recording media setting section which sets the restricted number of recording media of finishing process function by the finishing process section, wherein the restricted number of recording media can be adjusted within a prescribed range corresponding to a recording medium.

An image forming system comprising: an image forming section; a finishing process section capable of conducting plural finishing processes for a recording medium ejected from the image forming section, wherein restriction contents of the combination of finishing process functions by the finishing process section are established; and a finishing process function resetting section which resets the restriction contents of the combination of the finishing process functions in accordance with a recording medium.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 5 is a data table showing finishing process restriction information.

FIG. 11 is a data table showing finishing process restriction information stored in non-volatile memory 21 of image forming apparatus l of an image forming system in the Third Embodiment.

DETAILED DESCRIPTION OF THE PREFERRED EMBODIMENTS

The preferred embodiments of the present invention will be described with reference to the accompanying drawings.

First Embodiment

Image forming system 100 in the First Embodiment of the invention will be explained in detail as follows, referring to FIG. 1-FIG. 9.

Figure 1:
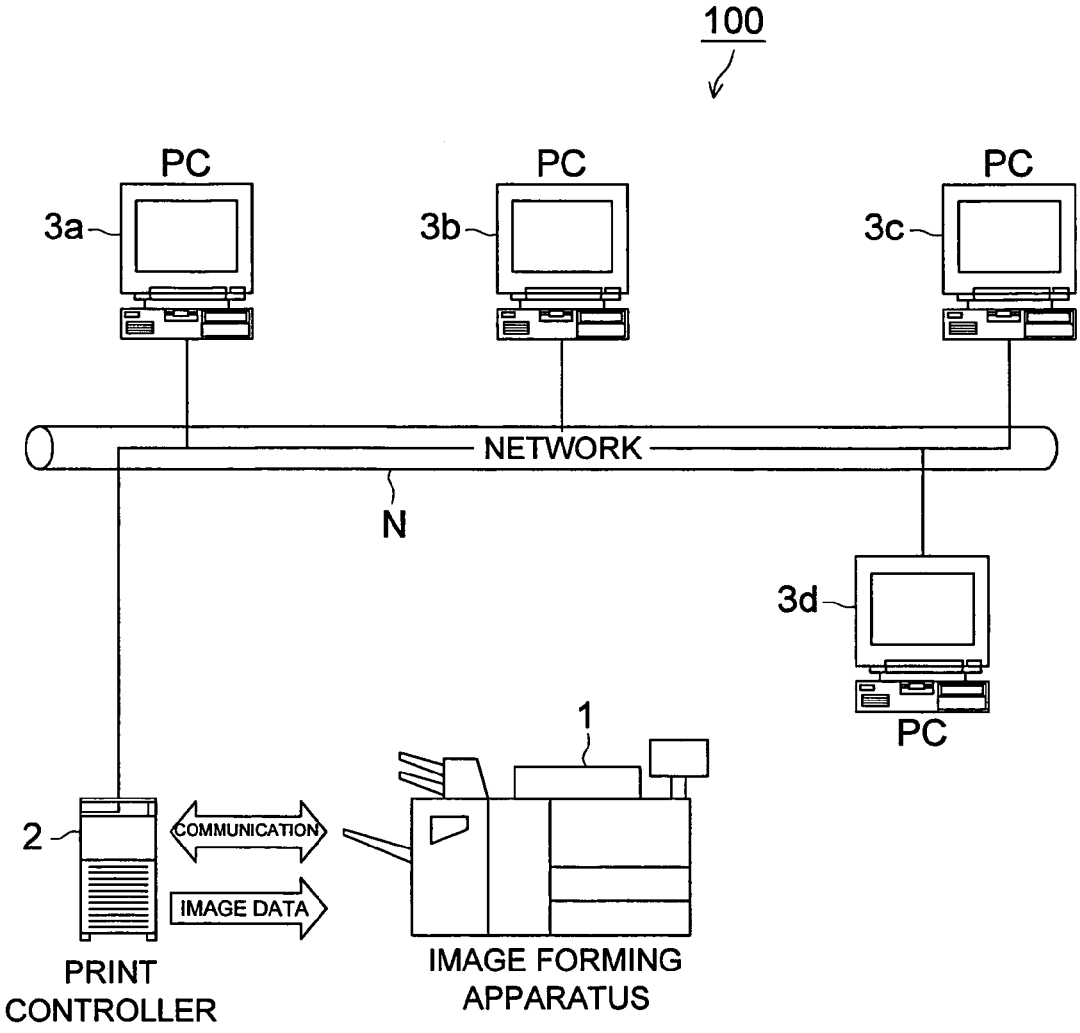
FIG. 1 is a system configuration diagram of image forming system 100 in the First Embodiment of the invention.

As shown in FIG. 1, image forming system 100 is composed of image forming apparatus 1, print controller 2 and personal computers 3*a*, 3*b*, 3*c* and 3*d*, and each apparatus is connected to others through network N such as LAN (Local Area Network). The image forming apparatus 1 is a multifunctional machine provided with a function of copying and with a function of a printer to form images based on image data transmitted from each of PCs 3*a*, 3*b*, 3*c* and 3*d*, and it functions as an image forming means. Each of PCs 3*a*, 3*b*, 3*c* and 3*d* has a function as an instructing device that instructs image forming and finishing process for the image forming apparatus 1.

Figure 2:
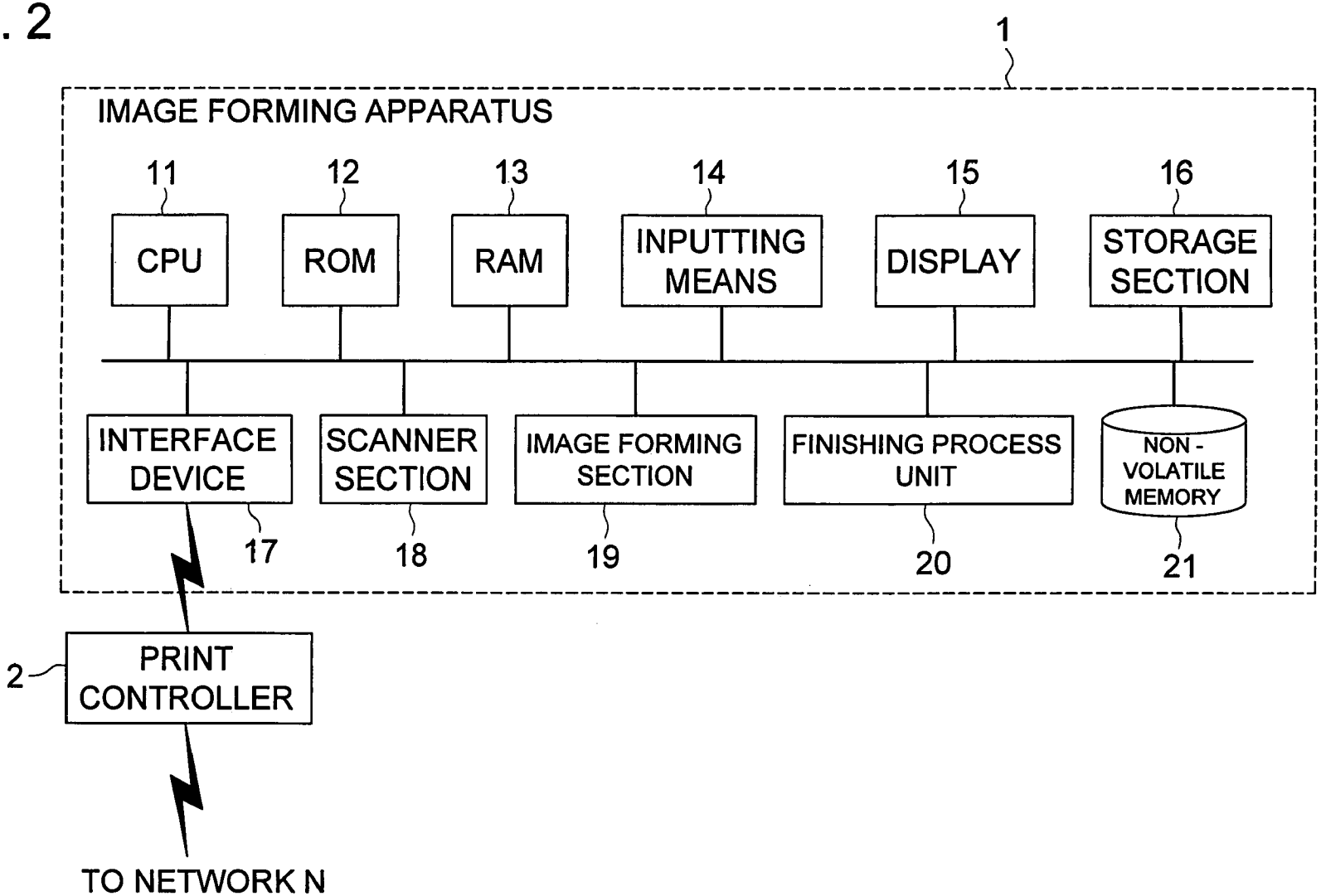
FIG. 2 is a block diagram showing functional configuration of image forming apparatus 1.

Functional configurations of the image forming apparatus 1 are shown in FIG. 2.

As shown in FIG. 2, the image forming apparatus 1 is composed of CPU (Central Processing Unit) 11, ROM (Read Only Memory) 12, RAM (Random Access Memory) 13, inputting means 14, display 15, memory 16, interface device 17, scanner section 18, image forming section 19, finishing work unit 20 and non-volatile memory 21, and each section is connected to others through the bus.

CPU 11 develops a program designated from various programs stored in ROM 12 on a work area of RAM 13 in accordance with various instructions inputted from inputting means 14 and with data inputted from interface device 17, then, executes various processes together with the aforesaid programs, and stores the results of processing in the prescribed area of RAM 13. A finishing process function resetting means and a restricted number of sheets setting means are realized by CPU 11, inputting means 14 and non-volatile memory 21.

ROM 12 is composed of non-volatile semiconductor memory, and it stores various programs and data executed by CPU 11.

RAM 13 is composed of rewritable semiconductor element, and it is a storage medium in which data are stored temporarily, and a program area on which a program executed by CPU 11 is developed, and a data area on which results of various processes conducted by CPU 11 are preserved are formed in the storage medium.

Inputting means 14 is provided with various operation buttons such as numeral buttons and start button, and it outputs operation signals prepared by button operations to CPU 11. Meanwhile, the inputting means 14 may also be composed of a touch panel that is united with display 15.

Display 15 is composed of LCD (Liquid Crystal Display), and it displays various types of set image planes, conditions of the apparatus and the state of operations of each function on a display screen, in accordance with instructions of display signals inputted from CPU 11.

Memory 16 is provided with HDD (Hard Disk Drive), and it stores various pieces of information including image data obtained by scanner section 18 and image data received by interface device 17.

The interface device 17 is an interface for conducting transmission and receiving of various types of information such as image data between the outside and the interface.

The scanner section 18 is composed of a light source, a lens and CCD (Charge Coupled Device), and it reads images of a document to obtain image data, by forming an image from reflected light of a light beam used for lighting scanning on a document from a light source.

Image forming section 19 is composed of a photoconductor drum, a developing unit and a fixing unit, and so on. In accordance with an instruction coming from CPU 11, the image forming section 19 forms an electrostatic latent image of the image on a surface of the photoconductor drum, then, sticks toner on an area including the electrostatic latent image on the surface of the photoconductor drum, and transfers toner on a recording sheet representing a recording medium for fixing the toner to eject to finishing work unit 20.

Figure 3:
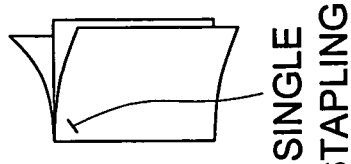
FIG. 3 shows diagrams illustrating stapling process, process of binding in the middle, folding process and punching process.
Figure 3:
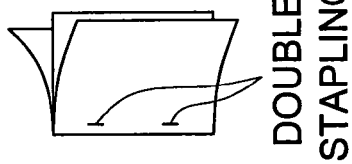
Figure 3:
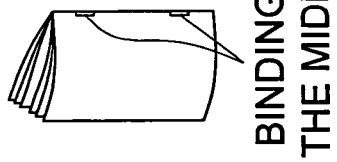
Figure 3:
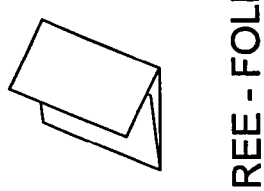
Figure 3:
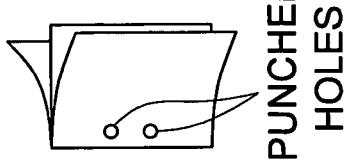

For the recording sheet having thereon formed images ejected from the image forming section 19, the finishing work unit 20 conducts finishing processes such as stapling process, process of binding in the middle, folding process and punching process shown in FIGS. 3(*a*)-3(*e*).

Figure 4:
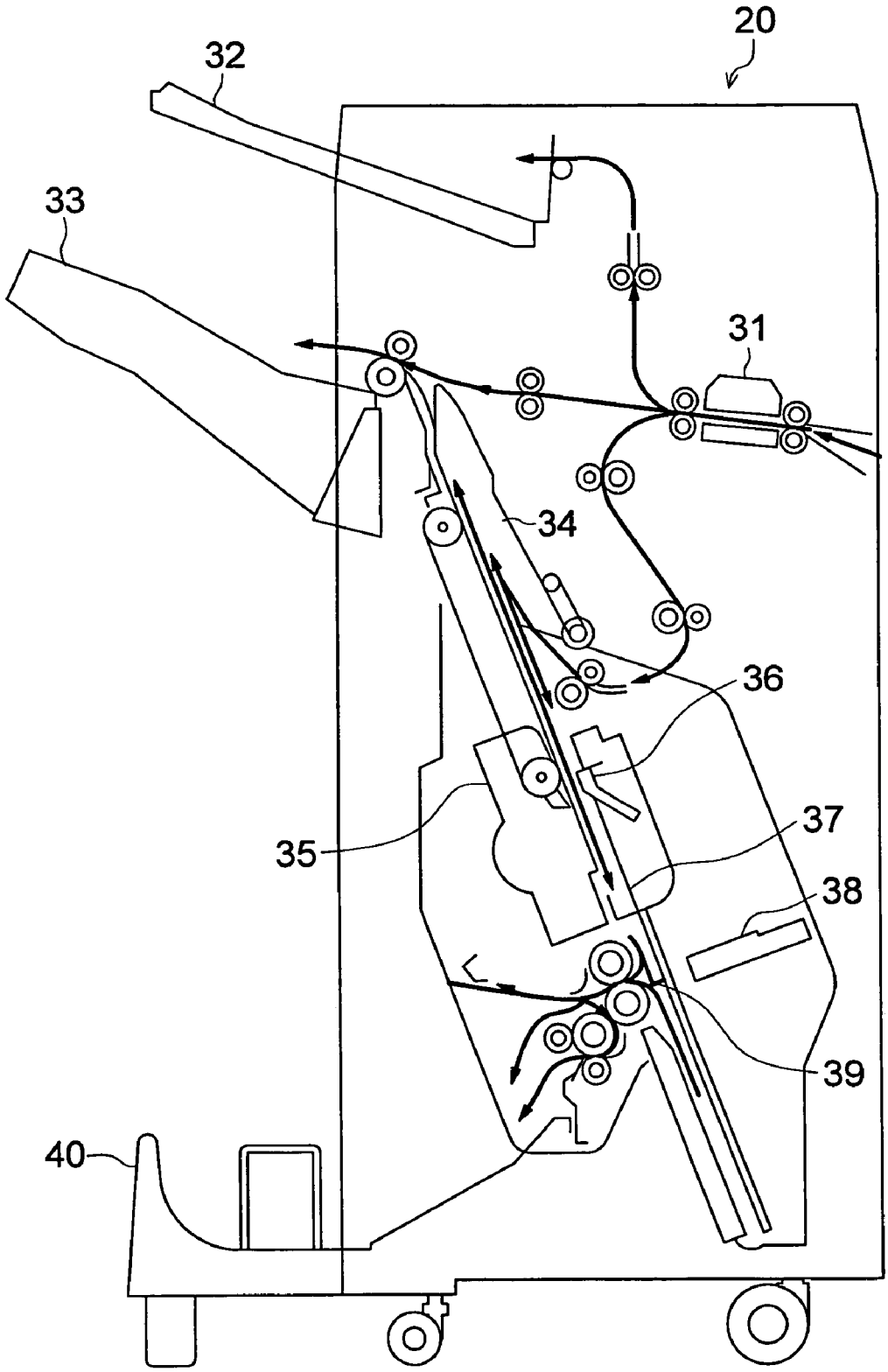
FIG. 4 is a cross-sectional view of finishing work unit 20.

FIG. 4 is a cross-sectional view of finishing work unit 20. As shown in FIG. 4, the finishing work unit 20 is provided with punch unit 31, sub-tray 32, main tray 33, stacker 34, stapler 35, side binding stopper 36, booklet stopper 37, folding knife 38, matching plate 39 and booklet tray 40.

When conducting the punching process, a recording sheet ejected from the image forming section 19 is stopped temporarily under the punch unit 31, and holes are punched on the recording sheet by the punch unit 31. The recording sheet that has been subjected to punching process is conveyed to be ejected to the main tray 33 or the stacker 34.

When conducting the stapling process, a recording sheet is accumulated on the stacker 34 temporarily, and it is stacked in a way that its leading edge is positioned at the side binding stopper 36. After the recording sheets in a quantity equivalent to the number of sheets in one set of sheets to be stapled are heaped on the stacker 34, one set is subjected to stapling process by the stapler 35, and is ejected to the main tray 33 one set by one set.

When conducting the process of binding in the middle, a recording sheet is accumulated on the stacker 34 temporarily, and it is stacked in a way that its leading edge is positioned at the booklet stopper 37. After the recording sheets in a quantity equivalent to the number of sheets in one set of sheets to be subjected to the process of binding in the middle are heaped on the stacker 34, one set is subjected to stapling process by the stapler 35, and is ejected to the booklet tray 40 one set by one set.

When conducting process of folding in the middle, a recording sheet is accumulated on matching plate 39 temporarily, and when the recording sheets in a quantity equivalent to the number of sheets in one set of sheets to be subjected to processing of folding in the middle are heaped on the matching plate 39, a fold is formed by the folding knife 38 on the central portion of the sheets, and one set of recording sheets is ejected to booklet tray 40 one set by one set.

When conducting three-fold process, a recording sheet is accumulated on matching plate 39 temporarily, and when the recording sheets in a quantity equivalent to the number of sheets in one set of sheets to be subjected to three-fold processing are heaped on the matching plate 39, a fold is formed by the folding knife 38 at each of two prescribed positions of the recording sheets, and one set of recording sheets is ejected to booklet tray 40 one set by one set.

In non-volatile memory 21, there is stored finishing process restriction information for each finishing process function of finishing work unit 20 for each recording sheet. The finishing process restriction information means information showing contents of restriction for the finishing process function established for the finishing work unit 20. The information showing contents of restriction for the finishing process function includes, for example, information of restricted number of sheets for the finishing process function and prohibited items for the finishing process function. The prohibited items for the finishing process function mean finishing process items for which the practice is established to be impossible. Further, recording sheets are classified in terms of a type of sheet, basic weight and a size. The basic weight is expressed by the number of grams per one square meter, and a sheet is heavier (thicker) when the numerical value of its basic weight is greater.

FIG. 5 is a data table showing finishing process restriction information. As shown in FIG. 5, there are stored information showing whether stapling process, process of binding in the middle, process of folding in the middle, three-fold processing and punching process can be practiced or not for each recording sheet, namely, for each classification of the recording sheet, and there are stored information showing the restricted number of sheets to be practiced for finishing processes which can be practiced. For example, there are shown, in the case of plain paper ranging from 64 g/m$^2$ to 74 g/m$^2$ in terms of basic weight, there are shown that the restricted number of sheets for stapling processing is 50, the restricted number of sheets for processing of binding in the middle is 20, the restricted number of sheets for processing of folding in the middle is 3, the restricted number of sheets for three-fold processing is 3, and punching process can be practiced. Further, the items for which the practice of finishing processing is prohibited among finishing process functions of finishing work unit 20 are set to be "impossible". Incidentally, for the punching process, no restricted number of sheets is shown because the punching process is a function to punch holes on each sheet, and only information shown is whether the practice is possible or not (possible/impossible). Meanwhile, "for each recording sheet" means for each nature of the recording sheet, such as, for example, type of recording sheet (plain paper, fine-quality paper, coated paper and label paper) and for each basic weight (g/m$^2$).

An initial value of the restricted number of sheets for each finishing process function is set on a product guarantee value determined based on at least one of sheet type, basic weight and size of the recording sheet. The product guarantee value is a value that is determined for each recording sheet to be used and guarantees the operations of the finishing work unit 20. The maximum value of a range wherein the restricted number of sheets can be changed is a value greater than the initial value, and it is set to the value determined in advance based on at least one of a sheet type, basic weight and a size of the recording sheet. In this case, "the value determined in advance" is a value that causes mechanical damage on the finishing work unit 20 when setting is made to the value that is not less than the value determined in advance, and it is not a threshold that causes jam on the finishing work unit 20 and makes the finish in the finishing process to be insufficient. The restricted number of sheets for each finishing process functions can be changed within a range from the initial value to the maximum value.

Figure 6:
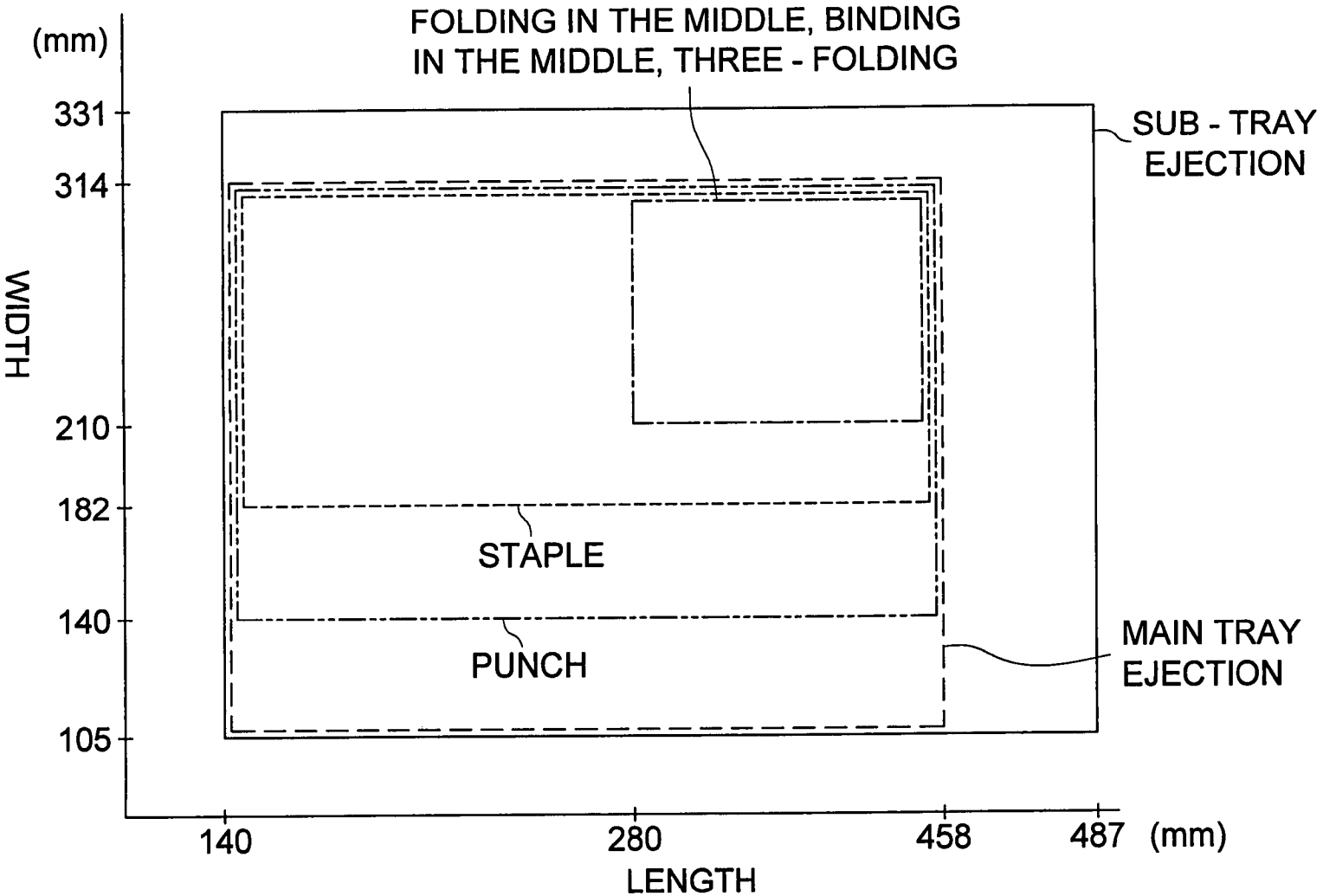
FIG. 6 is a diagram showing finishing process restriction for sizes of recording sheets.

FIG. 6 shows information of finishing process restriction for sizes of recording sheets. The horizontal axis represents a length (mm) of the recording sheet and the vertical axis represents a width (mm) of the recording sheet, and a range of recording sheet sizes allowed for each finishing process is shown in a form of a rectangle. As shown in FIG. 6, a range of recording sheet sizes which can be ejected to a main tray is from 140 mm to 458 mm for the sheet length, and from 105 mm to 314 mm for the sheet width. A range of recording sheet sizes which can allow stapling process is from 140 mm to 458 mm for the sheet length, and from 182 mm to 314 mm for the sheet width. A range of recording sheet sizes which can allow process of folding in the middle, process of binding in the middle and three-fold processing is from 280 mm to 458 mm for the sheet length, and from 210 mm to 314 mm for the sheet width. Prohibited items for finishing process functions are established depending on sizes of the recording sheet as stated above.

Figure 7:
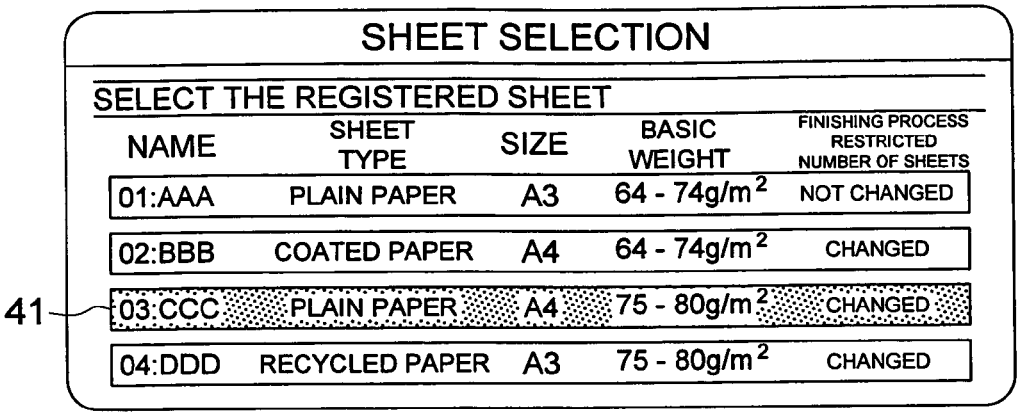
FIG. 7 shows an example of a set image plane, in the case of resetting a restricted number of sheets for the finishing process function in image forming apparatus 1.
Figure 7:
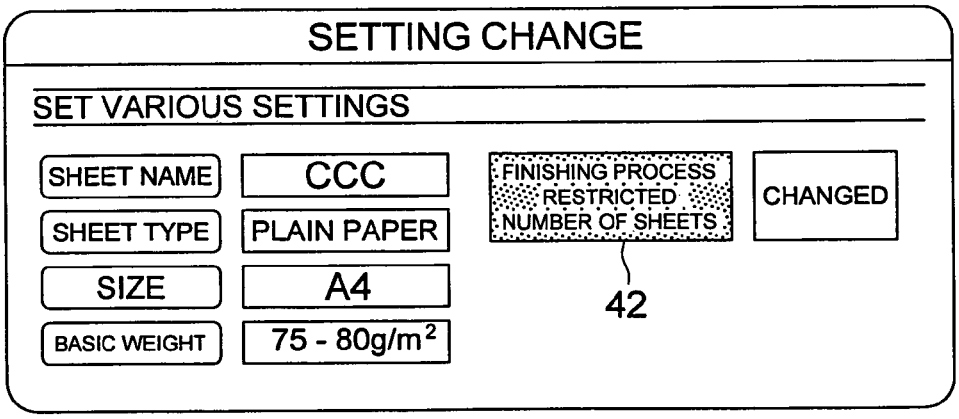
Figure 7:
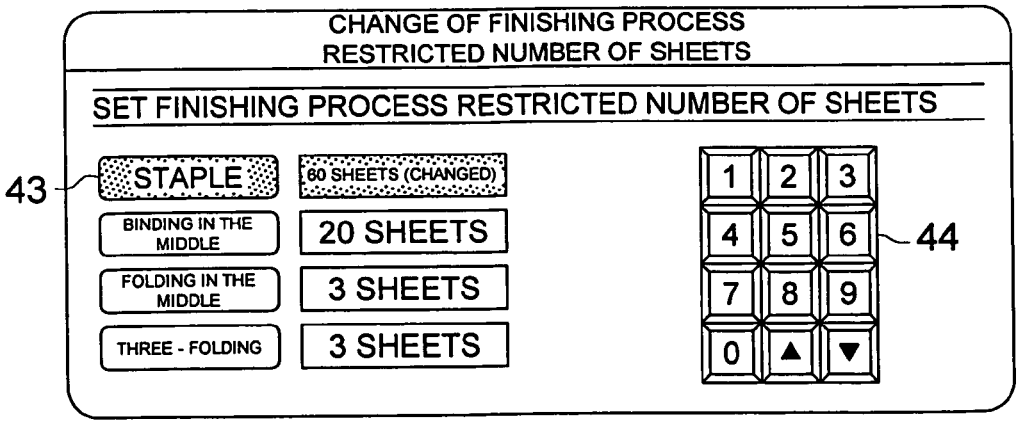

Information of finishing process restriction shown in FIG. 5 and FIG. 6 can be changed. When resetting the restricted number of sheets for finishing process functions in image forming apparatus 1, a sheet selection screen is displayed on display 15 as shown in FIG. 7(*a*). Each recording sheet is classified in terms of a sheet type, a size and a basic weight and is registered as shown in FIG. 7(*a*). When the restricted number of sheets for finishing process is changed from the initial value, "changed" is displayed. A user selects the recording sheet representing the subject of change, following the instruction coming from inputting means 14. When recording sheet "CCC" button 41 is selected on the sheet selection screen in FIG. 7(*a*), a setting change screen is displayed on display 15 as shown in FIG. (*b*). When "finishing process restricted number of sheets" button 42 is selected on the setting change screen, a finishing process restricted number of sheets change screen is displayed on display 15 as shown on FIG. 7(*c*). In the finishing process restricted number of sheets change screen, when the restricted number of sheets for stapling process is changed, "staple" button 43 is selected, and the restricted number of sheets is reset by inputting the restricted number of sheets from numeral button 44. The change of the restricted number of sheets is reflected on finishing process restriction information and it is stored in non-volatile memory 21. Further, in addition to the change of the restricted number of sheets, it is also possible to change so that finishing process functions may be practiced for the recording sheet on which the practice of finishing process functions is prohibited.

When changing the finishing process restriction information, trial output is conducted under the state where setting has been changed to check occurrence of jam, buckling in stapling process, a shape of a hole in punching process and a hole in folding process, and the finishing process restriction information is made to be usable, after that information is judged not to be problematic, which is preferable. When a problem is caused in the course of the trial output, the setting can be changed to the value which does not cause a problem, by conducting the output again by reducing the number of sheets to be outputted.

Incidentally, with regard to whether to make resetting of the finishing process restriction information to be possible or not, a selection is made possible by operating from inputting means 14 on the prescribed screen for setting displayed on display 15. For example, it is also possible to employ a system wherein a serviceman only can change the finishing process restriction information in the case of default, and for general users, the change of the finishing process restriction information is allowed in accordance with a user's demand, because there is a possibility that some users dislike an increase of items to be adjusted.

Next, operations will be explained.

Figure 8:
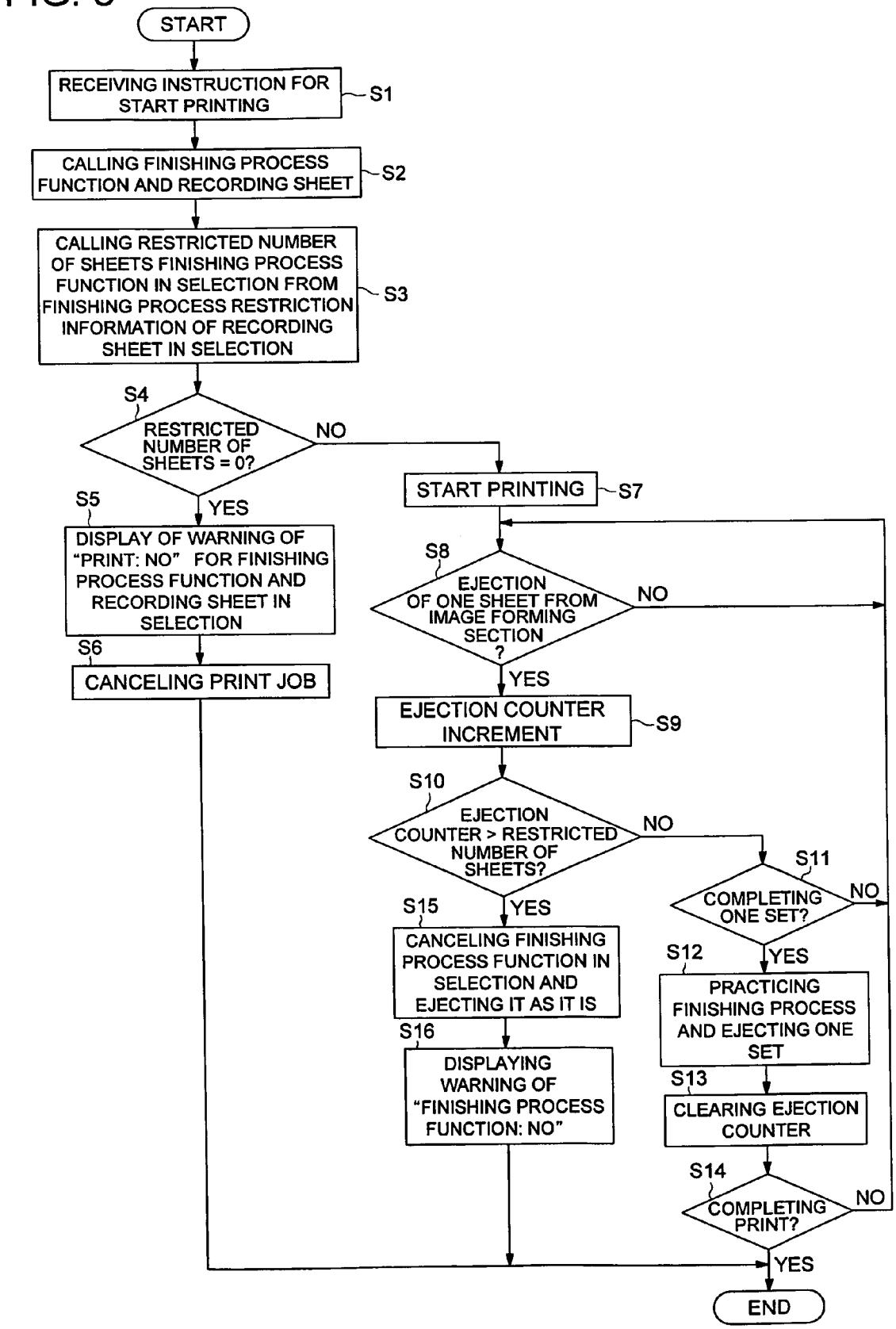
FIG. 8 is a flow chart showing printer mode processing carried out by image forming apparatus 1.

FIG. 8 is a flow chart showing a printer mode processing conducted by image forming apparatus 1. The printer mode processing is one that is conducted when an instruction for starting prints is transmitted from PC 3*a*, 3*b*, 3*c* or 3*d* to the image forming apparatus 1.

As shown in FIG. 8, when the instruction for starting prints is received by the image forming apparatus 1 (step S1), a finishing process function selected from the instruction for starting prints and a recording sheet are called (step S2). Then, the restricted number of sheets of the finishing process function in selection is called from the finishing process restriction information of the recording sheet in selection (step S3).

In this case, when the restricted number of sheets is 0 (step S4; Yes), display 15 indicates a warning that printing is not allowed for the finishing process function and the recording sheet both in selection (step S5), and after that, selection of the finishing process function is made impossible. Meanwhile, the warning that printing is not allowed may also be displayed on display screens of PCs 3*a*, 3*b*, 3*c* and 3*d*. Then, print job is canceled (step S6), and processing is terminated.

In step S4, when the restricted number of sheets is not 0 (step S4; No), printing is started (step S7). Each time a piece of recording sheet is ejected to finishing work unit 20 from image forming section 19 (step S8; Yes), an ejection counter is incremented (step S9).

When the ejection counter is not more than the restricted number of sheets (step S10; No), whether a part of the recording sheet is ejected from the image forming section 19 to the finishing work unit 20 or not is judged, and when a part is not terminated (step S1; No), a flow returns to step S8. When a part is terminated (step S11; Yes), the selected finishing process is conducted, and a part is ejected from the finishing work unit 20 (step S12). Then, the ejection counter is cleared to 0 (step S13), and whether printing is terminated or not is judged (step S14). When the printing is terminated (step S14; Yes), the processing is terminated, when the printing is terminated (step S14; No), the flow returns to step S8.

When the ejection counter exceeds the restricted number of sheets in step S10 (step S10; Yes), the finishing process function in selection is canceled, and the finishing process is not conducted and the recording sheet is ejected out as it is (step S15). Then, warning that finishing process function is not allowed is indicated on display 15 (step S16), and the processing is terminated.

Thus, the printer mode processing is terminated.

Next, copier mode processing conducted by image forming apparatus 1 will be explained as follows, referring to FIG. 9. The copier mode processing is a process carried out when copying is conducted on the image forming apparatus 1.

Figure 9:
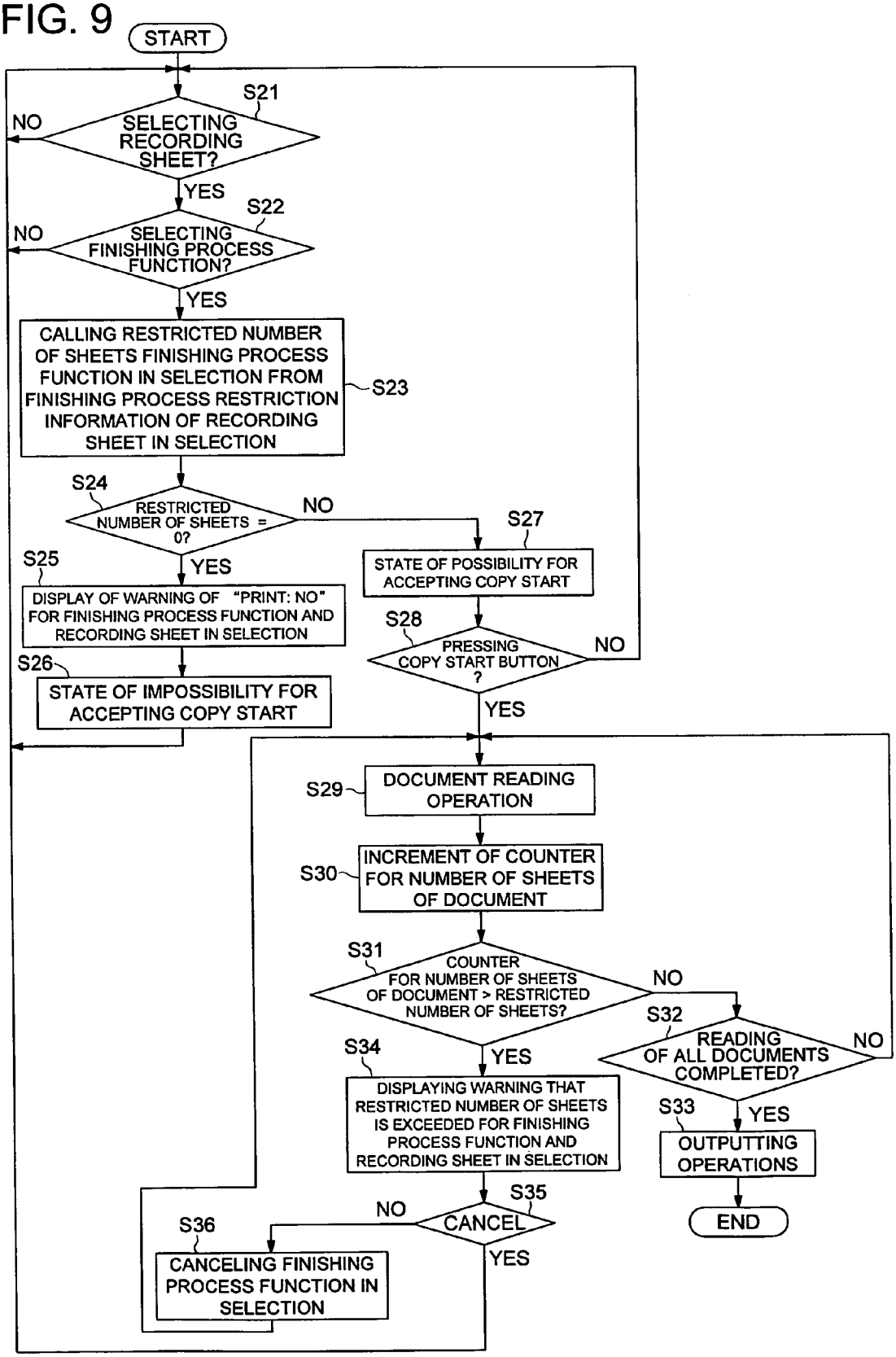
FIG. 9 is a flow chart showing copier mode processing carried out by image forming apparatus 1.

First, whether the recording sheet is selected from inputting means 14 or not is judged as shown in FIG. 9 (step S21). When the recording sheet is selected (step S21; Yes), it is judged whether the finishing process function is selected from inputting means 14 or not (step S22). When the recording sheet is not selected in step S21 (step S21; No), or when the finishing process function is not selected in step S22 (step S22; No), the flow returns to step S21. When the finishing process function is selected (step S22; Yes), the restricted number of sheets of the finishing process function in selection is called from the finishing process restriction information of the recording sheet in selection (step S23).

In this case, when the restricted number of sheets is 0 (step S24; Yes), display 15 indicates a warning that copying is not allowed for the finishing process function and the recording sheet both in selection (step S25), and after that, selection of the finishing process function is made impossible. Then, there comes the state wherein copy start cannot be accepted (step S26), and flow returns to step S21.

In step S24, when the restricted number of sheets is not 0 (step 24; No), there comes the state wherein copy start can be accepted (step S27). Then, when a copy start button is pressed down (step S28; Yes), operations to read a document with scanner section 18 are started (step S29). Each time a sheet of a document is read in the scanner section 18, a counter for the number of sheets of a document is incremented (step S30).

When a readout of the counter for the number of sheets of a document is not more than the restricted number of sheets (step S31; No), it is judged whether the reading of all documents is completed or not, and when the reading of the documents is not completed (step S32; No), the flow returns to step S29. When the reading of all documents is completed (step S32; Yes), output operations are carried out based on image data which have been read (step S33). Image forming is carried out by image forming section 19, and finishing process selected by finishing work unit 20 is carried out, and processing is terminated.

In step S31, when a readout of the counter for the number of sheets of a document exceeds the restricted number of sheets (step S31; Yes), a warning saying that the restricted number of sheets is exceeded for the finishing process function and the recording sheet in selection is displayed (step S34). When canceling the copy job (step S35; Yes), the flow returns to step S21.). When the copy job is not canceled (step S35; No), the finishing process function in selection is canceled (step S36), and the flow returns to step S29. After the finishing process function is canceled, the restricted number of sheets becomes infinite, and after all documents are read (step S32; Yes), finishing process is not carried out to be outputted (step S33).

Thus, the copy mode processing is terminated.

In image forming apparatus 1 in the First Embodiment, restriction contents of the finishing process function established for finishing work unit 20 can be reset depending on the recording sheet, whereby, finishing process functions prohibited for a certain recording sheet can be made practicable, or the restricted number of sheets for finishing process functions for a certain recording sheet can be changed to the greater value. Therefore, the finishing process functions can be practiced most effectively depending on the recording sheet to be used.

Further, when the number of recording sheets to be used for finishing process functions exceeds the restricted number of sheets, it is possible to output without conducting the finishing process functions, by prohibiting them. Further, when the recording sheet for which the restricted number of sheets is set to 0 is selected, it is possible to make the selection of the finishing process functions to be impossible for that recording sheet.

Incidentally, though it is judged whether the finishing process is practicable or not based on the number of sheets ejected from the image forming section 19 to the finishing work unit 20, in printer mode processing, it is also possible to transmit finishing process restriction information stored in non-volatile memory 21 to PCs 3*a*, 3*b*, 3*c* and 3*d* in advance through print controller 2, and to change the setting in printer driver provided in each of PCs 3*a*, 3*b*, 3*c* and 3*d*. When instructing the image forming and finishing process for image forming apparatus 1 on printer drivers of PCs 3*a*, 3*b*, 3*c* and 3*d*, when the recording sheet for which the restriction contents of finishing process functions are established is selected, finishing process functions exceeding the restricted number of sheets and finishing process functions which are prohibited are made not to be selected. Owing to this, selection of the finishing process function that exceeds the prohibited range or restricted range can be prevented in advance.

Second Embodiment

Next, Second Embodiment to which the present invention is applied will be explained.

In the Second Embodiment, there will be explained image forming system 200 wherein finishing process restriction information showing restriction contents of finishing process functions which are reset in one image forming apparatus can be shared by other plural image forming apparatuses.

Figure 10:
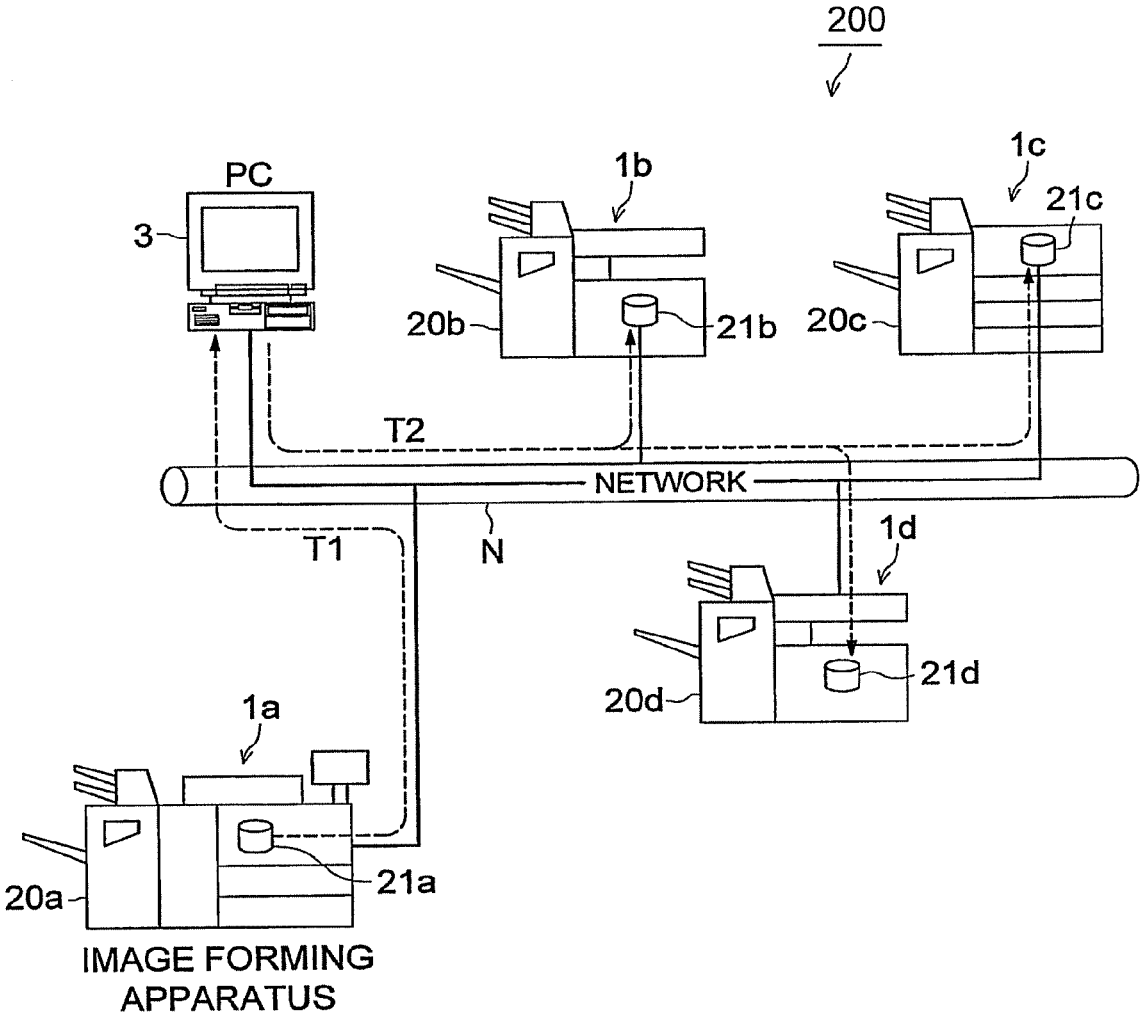
FIG. 10 is a system configuration diagram of image forming system 200 in the Second Embodiment of the invention.

System configurations of the image forming system 200 are shown in FIG. 10. As shown in FIG. 10, the image forming system 200 is composed of PC3 and image forming apparatuses 1*a*, 1*b*, 1*c* and 1*d* which are connected each other through network N. Since each of image forming apparatuses 1*a*, 1*b*, 1*c* and 1*d* is the same in terms of structure as the image forming apparatus 1 shown in the First Embodiment, the same constituent portion is given the same symbol to which each of a, b, c and d is added, and illustration and explanation of its structure will be omitted. Each of the image forming apparatuses 1*a*, 1*b*, 1*c* and 1*d* is provided with each of the same finishing work units 20*a*, 20*b*, 20*c* and 20*d*. Further, since PC 3 is the same as each of PCs 3*a*, 3*b*, 3*c* and 3*d* shown in the First Embodiment, the explanation thereof will be omitted. Processing that is distinctive to the Second Embodiment will be explained as follows.

As shown in FIG. 10, finishing process restriction information is downloaded from non-volatile memory 21*a* of image forming apparatus 1*a*, in PC 3 (step T1). Next, in PC 3, image forming apparatuses i*b*, 1*c* and 1*d* are designated, and downloaded finishing process restriction information is uploaded to image forming apparatuses 1*b*, 1*c* and 1*d* (step T2). In the image forming apparatuses 1*b*, 1*c* and 1*d*, finishing process restriction information in non-volatile memories 21*b*, 21*c* and 21*d* are changed. Thus, even in the image forming apparatuses 1*b*, 1*c* and 1*d*, finishing processes can be carried out based on new finishing process restriction information.

In the image forming system 200 in the Second Embodiment, finishing process restriction information that is reset in the image forming apparatus 1a can be shared by other image forming apparatuses 1*b*, 1*c* and 1*d* which are connected each other through network N, whereby, restriction contents of finishing process functions do not need to be reset for each image forming apparatus, restriction contents of finishing process functions can be changed efficiently.

Third Embodiment

Next, Third Embodiment to which the present invention is applied will be explained.

Since an image forming system in the Third Embodiment is the same in terms of structure as the image forming system 100 shown in the First Embodiment, the same constituting portion is given the same symbol to be shown, and illustration and explanation thereof will be omitted. Configuration and processing which are distinctive to the Third Embodiment will be explained as follows.

FIG. 11 is a data table showing finishing process restriction information stored in non-volatile memory 21 of image forming apparatus 1. As shown in FIG. 11, this data table stores information of whether feasible or not (possible or impossible) and feasible restricted number of sheets for stapling process, process of binding in the middle, process of folding in the middle, three-folding process, Z-shaped folding process, punching process and a combination of stapling process plus Z-shaped folding process, for each recording sheet. An initial value of the restricted number of sheets for each finishing process function or for a combination of finishing process functions is established on a product guarantee value determined based on at least one of sheet type, basic weight and size of the recording sheet. Incidentally, for the Z-shaped folding process, there is no restriction of the number of sheets for an independent processing, and what is established is whether the Z-shaped folding process is practicable or not, because it is a function to conduct processing one sheet by one sheet as in the punching process.

With regard to the stapling process and a combination of the stapling process and the Z-shaped folding process, there are established judgment whether the process is practicable or not or the practicable restricted number of sheets, depending on a sheet type, basic weight and a size (a length in the traveling direction) of the recording sheet.

For example, in the case of the stapling process, the restricted number of sheets for the length of the recording sheet in its traveling direction that is not more than 399 mm is 50 sheets and the restricted number of sheets for the length of the recording sheet in its traveling direction that is 400 mm or more is 25 sheets, both for plain paper having basic weight of 64 g/m$^2$-105 g/m$^2$, while, the restricted number of sheets for the length of the recording sheet in its traveling direction that is not more than 399 mm is 20 sheets and the restricted number of sheets for the length of the recording sheet in its traveling direction that is 400 mm or more is 10 sheets, both for plain paper having basic weight of 106 g/m$^2$-209 g/m$^2$. Further, in the case of plain paper having basic weight of 210 g/m$^2$-256 g/m$^2$ the stapling process is established to be not practicable even in the case that a length of the recording sheet in its traveling direction is not more than 399 mm and is not less than 400 mm.

By establishing the restricted number of sheets for stapling process to be less when the recording sheet is larger in size, it is possible to inhibit that a bundle after stapling becomes heavier as a recording sheet size grows greater, and a lowermost recording sheet is turned up and becomes creased, or the bundle cannot be ejected normally when the bundle is ejected on the ejection tray after the stapling process.

Further, in the case of a combination of the stapling process and the Z-shaped folding process, the restricted number of sheets for the length of the recording sheet in its traveling direction that is not more than 399 mm is 40 sheets and the restricted number of sheets for the length of the recording sheet in its traveling direction that is 400 mm or more is 20 sheets, both for plain paper having basic weight of 64 g/m$^2$-105 g/m$^2$, while, the restricted number of sheets for the length of the recording sheet in its traveling direction that is not more than 399 mm is 16 sheets and the restricted number of sheets for the length of the recording sheet in its traveling direction that is 400 mm or more is 8 sheets, both for plain paper having basic weight of 106 g/m$^2$-162 g/m$^2$. Further, in the case of plain paper having basic weight of 163 g/m$^2$-256 g/m$^2$, a combination of the stapling process and the Z-shaped folding process is established to be not practicable even in the case that a length of the recording sheet in its traveling direction is not more than 399 mm and is not less than 400 mm.

In the case of the combination of the stapling process and the Z-shaped folding process, the stapling process is conducted after the Z-shaped folding process is conducted. Therefore, a thickness of the bundle of recording sheets is greater than that in the case of no Z-shaped folding process is conducted, by a value equivalent to gaps generated in the direction of a sheet thickness. In the case of the combination of the stapling process and the Z-shaped folding process, therefore, the restricted number of sheets is established to be less than that in the case of the stapling process alone, which can inhibit that a thickness of the recording sheet bundle grows greater, and edges of the recording sheets cannot be lined up before conducting the stapling process.

Meanwhile, in FIG. 11, the restricted number of sheets is not established for each sheet size for the processing of binding in the middle. However, it is also possible to arrange so that the restricted number of sheets can be established for each sheet size, even for the processing of binding in the middle. In this case, the restricted number of sheets for a greater sheet size is made to be smaller than that for a smaller sheet size.

In FIG. 11, only contents of restriction for the combination of the stapling process and the Z-shaped folding process are established, as a combination of finishing process functions. However, it is also possible to establish whether the combination is practicable or not, or to establish the practicable restricted number of sheets, even for other combinations.

Finishing process restriction information shown in FIG. 11 can be changed. When resetting restriction contents for the finishing process function or for the combination of finishing process functions in image forming apparatus 1, a user selects the recording sheet to be changed by instructing from inputting means 14, on a sheet selection screen shown on display.15. Then, in the screen for changing the setting for the recording sheet to be changed, whether a finishing process function or a combination of the finishing process functions is practicable or not is reset, and the restricted number of sheets for the finishing process function or for the combination of finishing process functions is reset. This change is reflected on finishing process restriction information, and is stored in non-volatile memory 21.

After whether a finishing process function or a combination of the finishing process functions is practicable or not is reset, and the restricted number of sheets for the finishing process function or for the combination of finishing process functions is reset, the finishing process function or the combination of finishing process functions is controlled based on new finishing process restriction information.

In image forming apparatus 1 of an image forming system in the Third Embodiment, the restriction contents for the finishing process function or for the combination of finishing process functions established for the finishing work unit can be reset depending on the recording sheet. It is therefore possible to practice the finishing process function most effectively depending on the recording sheet to be used.

Incidentally, the description in each Embodiment is one showing an example of an image forming system relating to the invention, and the invention is not limited to the description. Details of the image forming system in the aforesaid embodiment can be varied without departing from the spirit and scope of the invention.

For example, though the image forming apparatus is of the structure wherein the finishing work unit is provided in the embodiment stated above, the invention can also be applied to the occasion where a separate finishing work apparatus is added to the image forming apparatus having no function of finishing process.

In each embodiment stated above, it is possible to practice the finishing process function most effectively depending on the recording medium to be used.

In each embodiment stated above, it is possible to practice the finishing process function most effectively depending on the recording medium to be used, because contents of restriction of the finishing process functions can be reset depending on the recording medium to be used.

Since finishing process restriction information showing contents of restriction of finishing process functions which are reset in one image forming apparatus among plural image forming apparatuses can be shared by other image forming apparatuses connected through the network, contents of restriction of finishing process functions do not need to be reset for each image forming apparatus, whereby, contents of restriction of finishing process functions can be changed efficiently.

In the instructing device, when the recording medium for which the contents of restriction of finishing process functions are established is selected, finishing process functions are controlled whether they can be selected or not, based on the finishing process restriction information, whereby, selection of the finishing process functions exceeding the prohibited or restricted range can be prevented in advance.

Since it is further possible to reset the prohibited items of the finishing process functions depending on the recording medium, the finishing process functions can be practiced most effectively depending on the recording medium to be used.

Since it is further possible to reset the restricted number of sheets for the finishing process functions depending on the recording medium, the finishing process functions can be practiced most effectively depending on the recording medium to be used.

Since it is further possible to set the restricted number of sheets for the finishing process functions within a prescribed range corresponding to the recording medium, the finishing process functions can be practiced most effectively depending on the recording medium to be used.

Since it is further possible to restrict the practice of the finishing process functions by the finishing process means based on information of the restricted number of sheets of the finishing process functions inputted for each recording medium, the finishing process functions can be practiced most effectively depending on the recording medium to be used.

Further, the restricted number of sheets can be set respectively for each finishing process function, and optimum setting can be done for each finishing process.

Since the initial value of the restricted number of sheets is set based on at least one of a type of a sheet of recording medium, basic weight and a size, a finishing process function can be practiced based on the initial value when the restricted number of sheets is not changed.

Since the maximum value of a range wherein the restricted number of sheets can be changed is a value greater than the initial value, and it is set to the value determined in advance based on at least one of a sheet type, basic weight and a size of the recording medium, the restricted number of sheets can be changed within a range from the initial value to the maximum value, which makes it possible to set within an optimum range corresponding to the recording medium.

It is further possible to allow resetting of the restricted number of sheets only when a change of the restricted number of sheets is desired by a user, because it is impossible to select whether resetting of the restricted number of sheets of finishing process functions is made to be possible or not.

It is further possible to practice finishing process functions most effectively, depending on the recording medium. to be used, because it is possible to reset the restriction contents for a combination of finishing process functions.

It is further possible to practice finishing process functions most effectively, depending on the recording medium to be used, because it is possible to reset whether a combination of finishing process functions is practicable or not, depending on the recording medium.

It is further possible to practice finishing process functions most effectively, depending on the recording medium to be used, because it is possible to reset the restricted number of sheets for a combination of finishing process functions.

There is described an image forming system including an image forming section, a finishing process section, wherein restriction contents of finishing process function are set in the image forming system, and a finishing process function resetting section that resets the restriction contents of the finishing process function in accordance with a recording medium.

What is claimed is:

1. An image forming system comprising:

an image forming section;

a finishing process section in which finishing process conducts for a recording medium ejected from the image forming section, wherein restriction contents of finishing process function by the finishing process section, which include restricted number of recording media for the finishing process, are set in the image forming system; and a finishing process function resetting section having a restricted number of recording media setting section that resets the restriction contents of the finishing process function, which include restricted number of recording media in accordance with a recording medium;

wherein if the number of recording media of the recording media on which the finishing process function is to be conducted exceeds the restricted number of recording media, outputting is carried out without conducting the finishing process.

2. The image forming system of claim 1, wherein the restriction contents include prohibited items of the finishing process function.

3. The image forming system claim 1, wherein the restricted number of recording media setting section has an inputting section for inputting information of restricted number of recording media of the finishing process function for each recording medium, a storage section that stores the information of restricted number of recording media inputted to be capable of being rewritten and a control section that restricts the execution of finishing process function of the finishing process section based on information of restricted number of recording media stored in the storage section.

4. The image forming system of claim 1, wherein the restricted number of recording media can be set respectively for each finishing process function.

5. The image forming system of claim 1, wherein if the number of recording media of the recording media on which the finishing process function is to be conducted exceeds the restricted number of recording media, outputting is conducted out by prohibiting the finishing process function.

6. The image forming system of claim 1, wherein if a recording medium for which the restricted number of recording media is set to 0 is selected, the finishing process function is caused not to be selectable for the recording medium.

7. The image forming system of claim 1, wherein an initial value of the restricted number of recording media is set based on at least one of a type, basic weight and a size of the recording medium.

8. The image forming system of claim 7, wherein an initial value of the restricted number of recording media is set in a product guarantee value determined based on at least one of a type, basic weight and a size of the recording medium.

9. The image forming system of claim 7, wherein a maximum value of a range wherein the restricted number of recording media can be changed is a value greater than the initial value, and the maximum value is set to the value determined in advance based on at least one of a type, basic weight and a size of the recording medium.

10. The image forming system of claim 1, further comprising:

a selecting section which selects whether to make the restricted number of recording media of the finishing process function to be capable of being reset by the restricted number of recording media setting section or not.

11. An image forming system comprising:

a plurality of image forming apparatuses each comprising:

an image forming sections; and a finishing process section in which finishing process conducts for a recording medium ejected from the image forming section, in which wherein restriction contents of finishing process function by the finishing process section are set in each image forming apparatus, and plural image forming apparatuses are connected each other through a networks;

wherein at least one of the plural image forming apparatuses is provided with a finishing process function resetting section that resets the restriction contents of the finishing process function in accordance with a recording medium, and finishing process restriction information showing the restriction contents of finishing process function reset in one of the plural image forming apparatuses are shared by other image forming apparatus.

12. The image forming system of claim 11, wherein a restriction contents include prohibited items of the finishing process functions.

13. The image forming system of claim 11, wherein the restriction contents include restricted number of recording media for the finishing process function, and the finishing process function resetting section has a restricted number of recording media setting section that resets the restricted number of recording media in accordance with the recording medium.

* * * * *